US005425914A

United States Patent [19]

Brown et al.

[11] Patent Number: 5,425,914

[45] Date of Patent: Jun. 20, 1995

[54] METHODS FOR INHIBITING CORROSION IN COOLING WATER SYSTEMS

[75] Inventors: J. Michael Brown, The Woodlands, Tex.; Herbert A. Roberts, Shafter, Calif.; John J. Herrold, Boulder City, Nev.

[73] Assignee: Betz Laboratories, Inc., Trevose, Pa.

[21] Appl. No.: 215,981

[22] Filed: Mar. 22, 1994

[51] Int. Cl.[6] ..... C23F 11/04; C23F 11/14

[52] U.S. Cl. ..... 422/16; 252/389.23; 252/390; 252/392; 422/12

[58] Field of Search ..... 422/7, 12, 14, 15, 16, 422/17; 252/390, 392, 389.23

[56] References Cited

U.S. PATENT DOCUMENTS

| | | | |
|---|---|---|---|
| 2,889,334 | 6/1959 | Hughes | 252/390 X |
| 3,597,007 | 8/1971 | Vondrak | 406/47 |
| 3,598,756 | 8/1971 | Heit | 252/389 |
| 3,629,104 | 12/1971 | Maddox, Jr. | 252/392 X |
| 3,699,047 | 10/1972 | Petrey, Jr. | 252/175 |
| 3,758,493 | 9/1973 | Maddox, Jr. | 252/390 X |
| 4,443,340 | 4/1984 | May et al. | 210/697 |
| 4,470,918 | 9/1984 | Mosier | 252/77 |
| 4,626,367 | 12/1986 | Kuwamoto et al. | 252/49.5 |
| 4,772,805 | 2/1988 | Martin | 422/12 X |
| 5,062,992 | 11/1991 | McCullough | 252/294 |
| 5,152,177 | 10/1992 | Buck et al. | 73/61.54 |

*Primary Examiner*—Robert J. Warden
*Assistant Examiner*—Robert Carpenter
*Attorney, Agent, or Firm*—Alexander D. Ricci; Philip H. Von Neida

[57] ABSTRACT

A method of inhibiting the corrosion of iron-based metallurgies in contact with cooling water systems under severe corrosion inducing conditions comprising adding to said cooling water an aqueous combination of an alcohol, an acid, a fatty imidazoline, and an ethoxylated fatty diamine.

8 Claims, No Drawings

METHODS FOR INHIBITING CORROSION IN COOLING WATER SYSTEMS

FIELD OF THE INVENTION

Disclosed are methods for inhibiting the corrosion of iron-based metallurgies in industrial cooling water systems.

BACKGROUND OF THE INVENTION

In many industrial processes, undesirable excess heat is removed by the use of heat exchangers in which water is used as the heat exchange fluid. The term "cooling water" is applied wherever water is circulated through equipment to absorb and carry away heat. This definition includes air conditioning systems, engine jacket systems, refrigeration systems as well as the multitudes of industrial heat exchange operations, such as those found in oil refineries, chemical plants, steel mills, etc.

Preventing the corrosion of industrial heat transfer equipment is essential to the efficient and economical operation of a cooling system. Excessive corrosion of metallic surfaces can cause the premature failure of process equipment, necessitating downtime for the replacement or repair of the equipment.

Additionally, the buildup of corrosion products on heat transfer surfaces impedes water flow and reduces heat transfer efficiency, thereby limiting production or requiring downtime for cleaning, and can also cause rapid localized corrosion and sub sequent penetration of metallic surfaces through the formation of differential oxygen concentration cells. The localized corrosion resulting from differential oxygen cells originating from deposits is commonly referred to as "under-deposit corrosion". "Galvanic corrosion" can also occur if the corrosion products include metals different from that of the metal surface.

Chromate compounds, for years, provided protection to cooling water metallurgies, particularly when used in conjunction with polyphosphates, zinc and orthophosphates. With the advent of federal, state and municipal environmental controls, however, chromate became suspect for its environmental impact on lakes, streams, ponds and the like, where it might be discharged. Some industries, such as the petrochemical, petroleum, steel and chemical industries, chose to continue the use of chromates. This use necessitated high capital expenditures for either chromate removal or recovery systems, or for disposing of reduced chromate obtained by the natural treatment of effluents.

Further compounding the corrosion problem in the absence of chromates and the subsequent oxide film formed on the metal surfaces is the introduction of corrosive agents during the course of the cooling operation. These corrosive agents may include, for example, hypochlorite ions added for their biocidal action, sulfide ions present through process leaks, sulfate or chloride ions added as their hydrogen acids to control pH, or corrosion products that are dissolved, dispersed, or redeposited throughout the system. Additionally, higher temperature aqueous systems experience faster corrosion rates due to higher dissolved oxygen levels and a tendency for corrosion inhibiting chemicals to deteriorate.

SUMMARY OF THE INVENTION

The present invention relates to methods for inhibiting the corrosion of iron-based metallurgies in contact with cooling waters in industrial processes.

The methods of the instant invention provide an aqueous combination that is particularly effective at inhibiting the corrosion of iron-based metallurgies in severe water conditions exhibiting low pH, low hardness and high $H_2S$ levels.

DESCRIPTION OF THE RELATED ART

In U.S. Pat. No. 3,669,047, Petrey, a composition and method of inhibiting corrosion and scale deposition in cooling water systems are disclosed. It consists of a composition comprised of either a sodium, ammonium or potassium lignosulfonate, and alkyl sulfonic acid and a divalent metal ion such as zinc or cadmium. The focus of the invention of this patent is for use in a dynamic system in which water is constantly moving past the metallic components.

U.S. Pat. No. 3,598,756, Heit, discloses a corrosion inhibitor for use in cooling water systems. The patentee discloses a composition comprised of a polyvalent metal salt such as zinc, a nitrogen containing thio compound and a lignosulfonate, specifically limited to the calcium, potassium and sodium compounds thereof.

In U.S. Pat. No. 4,443,340, May et al., a corrosion inhibitor is disclosed for use in cooling water systems in which a protective oxide layer is laid down on the surface of the metallic parts in contact with the cooling water. The composition of the invention is comprised of a copolymer, an orthophosphate, and an ion selected from the group of zinc, nickel or chromium and sodium lignosulfonate.

DETAILED DESCRIPTION OF THE PREFERRED EMBODIMENTS

The present invention describes methods for inhibiting the corrosion of iron-based metallurgies in contact with cooling water systems comprising adding to said cooling water an aqueous solution of an alcohol, an acid, a fatty imidazoline, and an ethoxylated fatty diamine.

This combination proves particularly effective at inhibiting the corrosion of iron and iron-containing metals in contact with cooling water that is suffering from the severe effects of low pH, low hardness levels and high sulfide ion levels due to the introduction of $H_2S$. Additional corrosion problems also result when microbiological species are present as oxidizing and non-oxidizing agents are used to control their growth and further metal corrosion.

The alcohols useful in this invention are those that are water-soluble. Preferably, these alcohols are diethylene glycol monobutyl ether, butanol, butyl cellusolve, isopropanol, methanol, propylene glycol, 2-ethylhexanol, hexylene glycol, and glycolic acid.

The acids useful in this invention can be either organic or inorganic acids, preferably acetic acid or orthophosphoric acid. The inventors anticipate that fatty-substituted organic acids, glycolic acid and mono-, di-, or tricarboxylic acids or mixtures thereof will also be effective in the present invention.

The fatty imidazoline is preferably a tall oil fatty substituted imidazoline. These imidazolines are those compounds or mixtures of compounds prepared from long chain fatty acids, such as tall oil fatty acid, stearic acid, or oleic acid, or mixtures thereof and polyamines such as ethylenediamine, diethylenetriamine, triethylenetetramine or tetraethylenepentamine. The imidazoline employed in the examples was prepared by known methods from tall oil fatty acids and diethylenetriamine with a molar ratio of about 1.5:1. This reaction is disclosed in U.S. 5,062,992, which disclosure is wholly incorporated by reference herein.

The ethoxylated fatty diamine compound is preferably a tallowdiamine with 10 moles of ethylene oxide.

The preferred formulary comprises 22% water, 20% diethylene glycol monobutyl ether, 10% acetic acid, 24% tall oil fatty acid substituted imidazoline and 24% tallowdiamine with 10 moles ethylene oxide (an ethoxylated fatty diamine).

The total amount of the combined treatment used in the methods of the present invention is that amount which is sufficient to inhibit corrosion in the aqueous system sought to be treated. This will vary due to conditions such as type of iron metallurgy present, amount and type of sulfur compound present and water temperature.

Preferably, the total amount of the combined treatment may be added to the aqueous system in an amount ranging from about 1 part per million to about 1000 parts per million based on the amount of water to be treated. Most preferably, the total amount of the treatment is from about 5 to 100 parts per million parts water.

The combined treatment can be added to the water by any conventional method. The components can be added separately or as a combination. It is preferred to add the composition as a single treatment composition.

The present invention will now be further described with reference to a number of specific examples which are to be regarded solely as illustrative and not as restricting the scope of the invention.

EXAMPLES

Corrosion rates were evaluated at an industrial cooling water system at various points along the assembly. Mild steel coupons were installed in the cooling tower return header both before and after the sour condensate injection point. A customized coupon rack was installed at the return header, downstream of the sour condensate injection which allowed for one set of mild steel coupons to be exposed to the treatment while maintaining cooling water conditions for the others. Data was also taken on coupons installed upstream of the sour condensate injection. The tower water chemistry was:

| | |
|---|---|
| pH | 6.4–6.7 |
| Conductivity | 4370–4700 u5 |
| o-$PO_4$ | 10–15 ppm |
| [Ca] | 11–40 ppm $CaCo_3$ |
| Cycles | 5–10 |
| $H_2S$ | 3–5 ppm |

The results of this testing are reported in Tables I, II and III.

TABLE I

| Return header before sour condensate injection. | | |
|---|---|---|
| Exposure (Dates) | Corrosion (mpy) | Avg. Water Temp. (°F.) |
| 3/18–4/7 | 37 | 106 |

TABLE I-continued

| Return header before sour condensate injection. | | |
|---|---|---|
| Exposure (Dates) | Corrosion (mpy) | Avg. Water Temp. (°F.) |
| 3/18–4/7 | 37 | 106 |
| 3/18–4/7 | 37 | 106 |

TABLE II

| Return header after sour condensate injection. | | |
|---|---|---|
| Exposure (Dates) | Corrosion (mpy) | Avg. Water Temp. (°F.) |
| 3/18–3/25 | 42 | 106 |
| 3/25-4/7 | 25 | 106 |
| 3/27-4/7 | 23 | 106 |
| 3/18-4/7 | 26 | 106 |

TABLE III

| Return header after sour condensate injection. 50 ppm EXC-611, 5 GPM side stream | | |
|---|---|---|
| Exposure (Dates) | Corrosion (mpy) | Avg. Water Temp. (°F.) |
| 3/18-3/25 | 13 | 106 |
| 3/25-4/7 | 24* | 106 |
| 3/27-4/7 | 23* | 106 |
| 3/18-4/7 | 17 | 106 |

*Chemical feed interrupted on these occasions. It is thought that this caused the increased corrosion rates compared to the other samples.

As these tables indicate, the addition of the inventive combination inhibited the corrosion of steel in cooling waters that contain $H_2S$ and have low pH and hardness. The results, compared to the blank runs, show better corrosion inhibition while offering a more environmentally sound formulation than with chromates or phosphates.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method for inhibiting the corrosion of iron-based metallurgies in contact with cooling water systems comprising adding to a cooling water system an aqueous solution of an alcohol, orthophosphoric acid, a fatty imidazoline, and an ethoxylated fatty diamine.

2. The method as claimed in claim 1 wherein said alcohol is diethylene glycol monobutyl ether.

3. The method as claimed in claim 1 wherein said fatty imidazoline is a tall oil fatty acid substituted with diethylenetriamine.

4. The method as claimed in claim 1 wherein said ethoxylated fatty diamine is a tallowdiamine ethoxylated with 10 moles of ethylene oxide.

5. The method as claimed in claim 1 wherein said aqueous solution of alcohol, acid, fatty imidazoline, and ethoxylated fatty diamine are in a weight ratio of 20 to 10 to 24 to 24 with the remainder being water.

6. The method as claimed in claim 5 wherein said weight ratio is 20 to 10 to 36 to 12 with the remainder being water.

7. The method as claimed in claim 1 wherein said combination is added to said cooling water system in an amount ranging from about 1 to about 1000 parts per million parts water.

8. The method as claimed in claim 1 wherein said cooling water system contains sulfide ions.

* * * * *